United States Patent [19]

Tachibana et al.

[11] Patent Number: 4,960,097

[45] Date of Patent: Oct. 2, 1990

[54] AIR-FUEL RATIO CONTROL SYSTEM FOR TWO-CYCLE ENGINE

[75] Inventors: Fusao Tachibana; Hideyuki Ishikawa; Kazuo Suzuki, all of Tokyo, Japan

[73] Assignee: Fuji Jukogyo Kabushiki Kaisha, Tokyo, Japan

[21] Appl. No.: 436,692

[22] Filed: Nov. 15, 1989

[30] Foreign Application Priority Data

Nov. 18, 1988 [JP] Japan ..... 63-150618

[51] Int. Cl.[5] ..... F02D 41/34

[52] U.S. Cl. ..... 123/494; 123/73 A; 123/486; 123/488; 123/492

[58] Field of Search ..... 123/494, 492, 488, 486, 123/478, 73 A, 73 B, 73 C, 480

[56] References Cited

U.S. PATENT DOCUMENTS

| | | | |
|---|---|---|---|
| 4,305,351 | 12/1981 | Staerzl | 123/73 A |
| 4,446,833 | 5/1984 | Matsushita et al. | 123/494 |
| 4,461,260 | 7/1984 | Nonaka et al. | 123/73 A |
| 4,777,913 | 10/1988 | Staerzl et al. | 123/73 A |
| 4,840,148 | 6/1989 | Staerzl | 123/494 |

*Primary Examiner*—Andrew M. Dolinar

*Attorney, Agent, or Firm*—Beveridge, DeGrandi & Weilacher

[57] ABSTRACT

An air-fuel ratio control system for a two-cycle engine is disclosed, which includes a cylinder, a crank case serving also as a pressure chamber, a fuel injection unit including an injector and a pump, an engine speed detecting element for detecting the engine speed, and a throttle opening degree detecting element for detecting the opening degree of a throttle valve. The control system is constructed of a crank case temperature detecting element for detecting the temperature of the crank case; a first setting element for setting an increment correction coefficient for increasing a fuel injection quantity, in accordance with the temperature of the crank case detected by the crank case temperature detecting element; a second setting element for setting a basic fuel injection quantity in response to the engine speed and throttle opening degree detected by the engine speed and throttle opening degree detecting element; and a third setting element for setting a fuel injection quantity by correcting the basic fuel injection quantity set by the second setting element in accordance with the increment correction coefficient set by the first setting element.

6 Claims, 4 Drawing Sheets

AIR-FUEL RATIO CONTROL SYSTEM FOR TWO-CYCLE ENGINE

BACKGROUND OF THE INVENTION

The present invention relates to an air fuel ratio control system for a two-cycle engine wherein an intake air quantity is estimated by a throttle opening degree, and a basic fuel injection quantity is set by the estimated intake air quantity.

Recently, two-cycle engines including the following structure have been proposed. The engines use an injector to improve the response of an engine speed not only within a high speed range but also within a low speed range, and to purify exhaust gas emission.

For example, Japanese Utility Model Laid-open No. 58-169117(1983) discloses an air-fuel ratio control system for a two-cycle engine. In the system, a fuel injection quantity is set by an intake air quantity and an engine speed as parameters, and the fuel is injected from the injector at the predetermined injection timing.

Generally, there are two types of intake air quantity measurement systems for engines. One is measuring the intake air quantity with an intake air quantity sensor as in the Publication. The other estimates an intake air quantity from the engine speed and a throttle opening degree. The latter estimating type has simple structure and low production costs, so that it is used mainly for two-cycle engines.

In the estimating type, the intake air quantity has a complicated function relative to the engine speed and the throttle opening degree. It is therefore difficult in practice to estimate the intake air quantity correctly. Namely, the air density changes with the temperature of an intake air and with the temperature condition of the engine, even though the system has a constant engine speed and a constant throttle opening degree, thereby varying the charging efficiency to a large extent.

Accordingly, a proper air-fuel ratio of the engine has been obtained in the estimating type by correcting the estimated intake air quantity in dependency on various increment correction coefficients. These coefficients are set in accordance with an actual intake air temperature and coolant temperature of the engine under operation.

However, in case of two-cycle engine, the intake air is not directly supplied to a combustion chamber in difference with a four-cycle engine. In a two-cycle engine, the intake air is once supplied to a crank chamber also serving to a pressure chamber via a scavenging air passage under the pressure within the crank chamber exerted upon a down stroke of a piston during an ignition expansion cycle. Therefore, the intake air of the two-cycle engine remains within the engine longer than in a four-cycle engine, so that the temperature condition of the crank case gives a great influence on the air density required at the time of setting an air-fuel ratio.

Accordingly, in the conventional system not taking the temperature of the crank case into consideration, the fuel injection quantity is not set properly even with aforementioned various correction coefficients, thereby posing the problems of a poor controllability of the air-fuel ratio, and hence lowering the engine output and contaminating the exhaust gas emission.

SUMMARY OF THE INVENTION

An object of the present invention is to provide an air-fuel ratio control system for a two-cycle engine capable of presenting a fair controllability an air-fuel ratio, improving the engine output, fuel consumption, and exhaust gas emission, by correcting and properly setting a fuel injection quantity in accordance with a correction term corresponding to engine temperature conditions such as the crank case temperature.

In order to achieve the above object, the air-fuel ratio control system of the present invention comprises a first setting means for setting various increment correction coefficients in dependency on the temperature of a crank case also serving as a pressure chamber and various correction parameters; second setting means for setting a basic feel injection quantity in response to an engine speed and a throttle opening degree; and third setting means for setting a fuel injection quantity by correcting the basic fuel injection quantity set by a second setting means, in accordance with the various increment correction coefficients set by the first setting means.

In the air-fuel ratio control system constructed as above, the first setting means firstly set increment correction coefficients in dependency on the temperature of the crank case and various parameters. Then, the second setting means set a basic fuel injection quantity in dependency on the engine speed and throttle opening degree. Lastly, the third setting means correct the basic fuel injection quantity in accordance with the incremental correction coefficients to thereby obtain an actual fuel injection quantity.

By the above structure and function, it is possible to provide an air-fuel ratio control system for a two cycle engine capable of controlling a correct and proper air-fuel ratio while taking into consideration the temperature condition of the crank case, namely, the temperature condition of the engine.

DETAILED DESCRIPTION OF THE PREFERRED EMBODIMENTS

The preferred embodiments of the air-fuel ratio control system for a two-cycle engine according to the present invention will be described with reference to the accompanying drawings.

First, the outline of the air-fuel ratio control system for the two-cycle engine will be described with reference to FIGS. 1 to 3.

Figure 1:
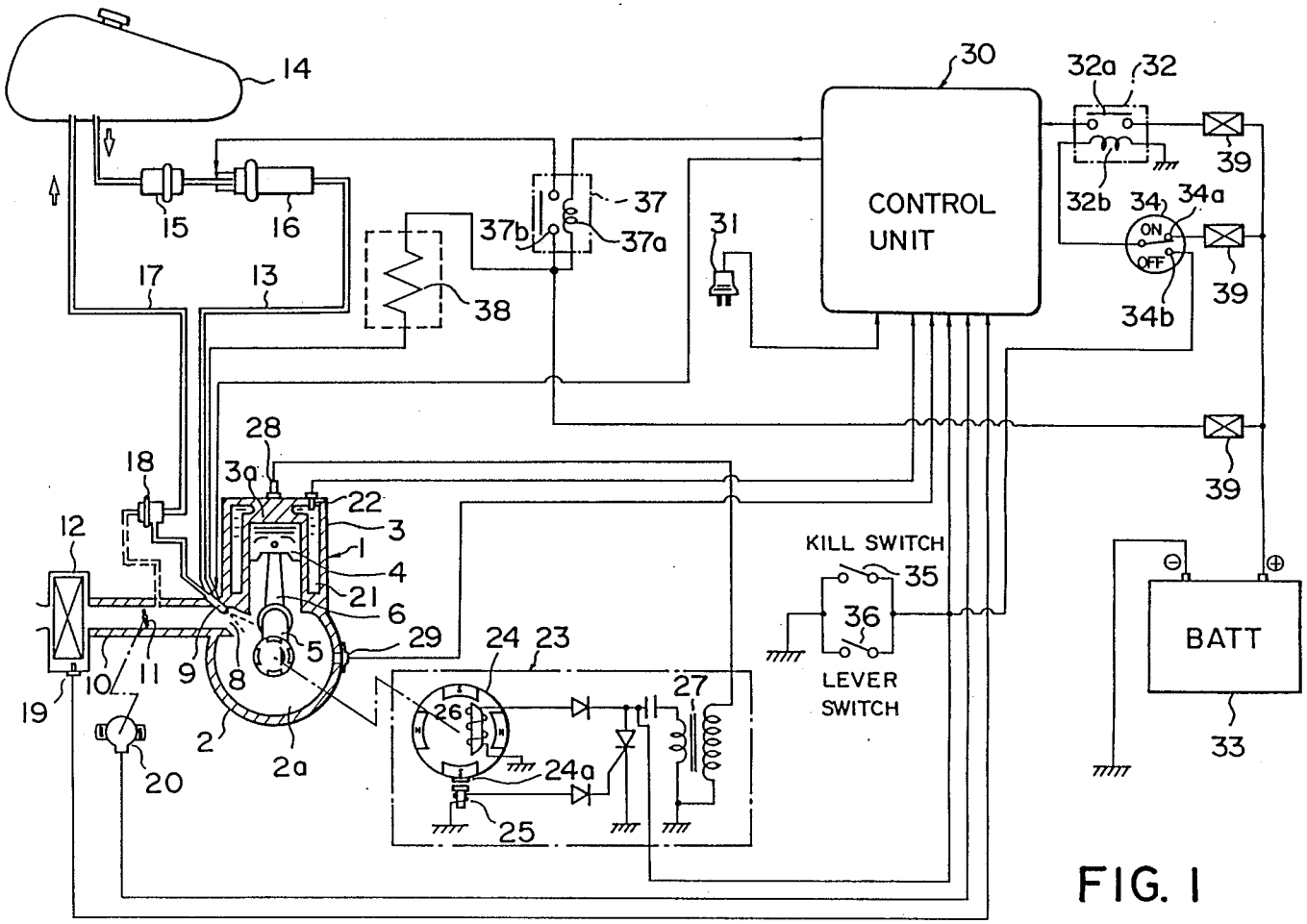
FIG. 1 is a block diagram briefly showing the outline of a two-cycle engine on which an air-fuel ratio control system according to an embodiment of the present invention is mounted.

As shown in FIG. 1, a two-cycle engine 1 mounted on e.g., a snow mobile is provided mainly with a crank case 2 and a cylinder block 3 with a piston 4. The crank case 2 is equipped with a crank chamber 2*a* within which a crank shaft 5 is mounted laterally. The piston 4 is coupled to the shaft 5 via a connection rod (con'cod) 6.

The crank chamber 2a communicates via a scavenging air passage and a scavenging air port (both not shown) with a combustion chamber 3a in the block 3 positioned above the piston 4. An intake air port 8 is opened at the crank chamber 2a, and an exhaust gas port (not shown) is opened at the combustion chamber 3a. The scavenging air port and exhaust gas port are made open and communicable during reciprocal motion of the piston 4 serving as a valve.

The intake air port 8 has an injector 9 positioned so as to face the crank chamber 2a, and is communicated with an intake air passage 10. The intake air passage 10 has a throttle valve internally thereof, and an air cleaner 12 at the upstream of the intake air passage 10. The injector 9 communicates via a fuel supply passage 13 with a fuel tank 14. The fuel supply passage 13 has a fuel filter 15 and fuel pump 16 in this order from the fuel tank side. A fuel return passage 17 different from the passage 13 is provided between the injector 9 and the tank 14. Along this passage 17, a pressure regulator 18 is mounted which regulates the fuel supply pressure by detecting a negative pressure downstream of the valve 11 in the intake air passage 10. An intake air temperature sensor 19 is positioned so as to face the dirty side of the air cleaner 12.

Various sensors other than the intake air temperature sensor 19 are provided at the periphery of the engine Specifically, a throttle sensor 20 is mounted at the throttle valve 11, and a coolant temperature sensor 22 is disposed in a coolant passage 21 formed in the block 3.

Mounted on the shaft 5 is a magneto unit 23 for capacitor discharge ignition device (CDI). The magneto unit 23 is coaxially fixed on the shaft 5 and provided with a rotary magneto 24, an ignition pickup 25, an ignition coil 26, and another ignition coil 27. The rotary magneto 24 has at its outer periphery of a projection 24a to be detected. The ignition pickup 25 is mounted facing the projection 24a at the outer periphery of the magneto 24, and generates an ignition gate voltage upon detection Of the projection 24a. The ignition coil 26 is disposed at the inner periphery of the magneto 24. The outer ignition coil 27 has a secondary winding connected to an ignition plug 28 positioned so as to face the combustion chamber 3a.

A crank case temperature sensor 29 is mounted on the crank case 2. The sensor 29 detects the temperature within the case 2 or the wall temperature of the case 2, and is made of a thermistor or the like similar to other temperature sensors. The sensors 19, 20, 22, and 29 are connected to the input side of a control unit 30 for the fuel injection.

Connected to the control unit 30 are the primary winding of the ignition coil 27 and an atmospheric pressure sensor 31 provided in the control unit 30. The unit 30 is also connected with a relay 32 for starting the control unit 30. The relay 32 has a switch unit 32a connected to the unit 30 and to a battery 33, and an exciter coil unit 32b connected to an ignition switch 34. The ignition switch 34 has an on-contact 34a, and an off-contact 34b which is connected to one ends of parallel connected KILL switch 35 and lever switch 36, the outer ends of the switches 35 and 36 being grounded.

Connected to the output side of the control unit 30 are a fuel pump drive circuit and injector drive circuit (both not shown in FIGS. and 3). The pump drive circuit is connected with a coil 37a of a fuel pump relay 37. A switch unit 37b of the relay 37 is connected to a dropping resister 38 and to the battery 33. The resistor 38 is connected via injector drive circuit (not shown) to the injector 9. Reference numeral 39 represents a fusible link connected between the battery 33 and the relays 32 and 37, and switch 34.

Figure 2:
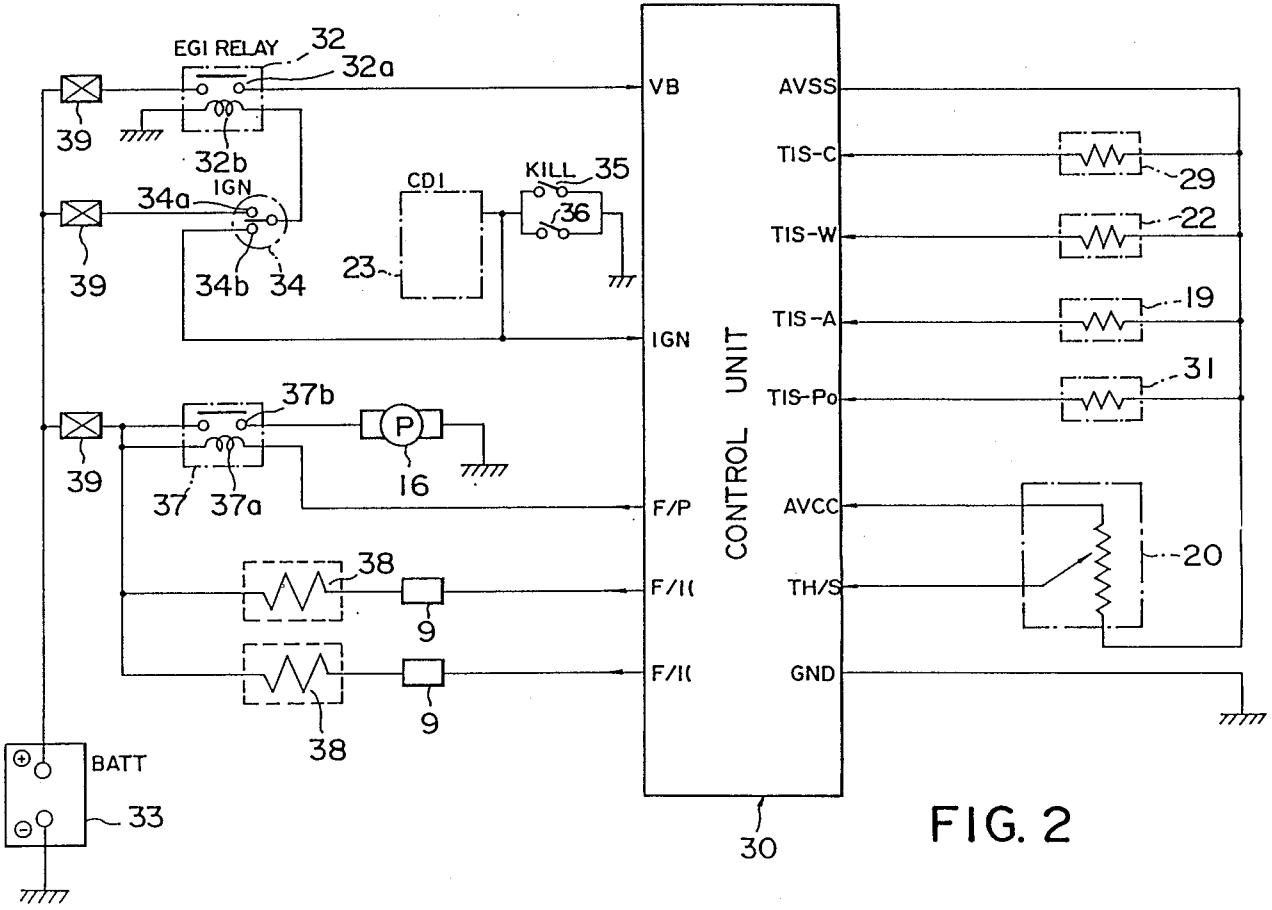
FIG. 2 is a circuit diagram in block form showing the connection state of various sensors and switches to an engine control unit including the embodiment shown in FIG. 1.
Figure 3:
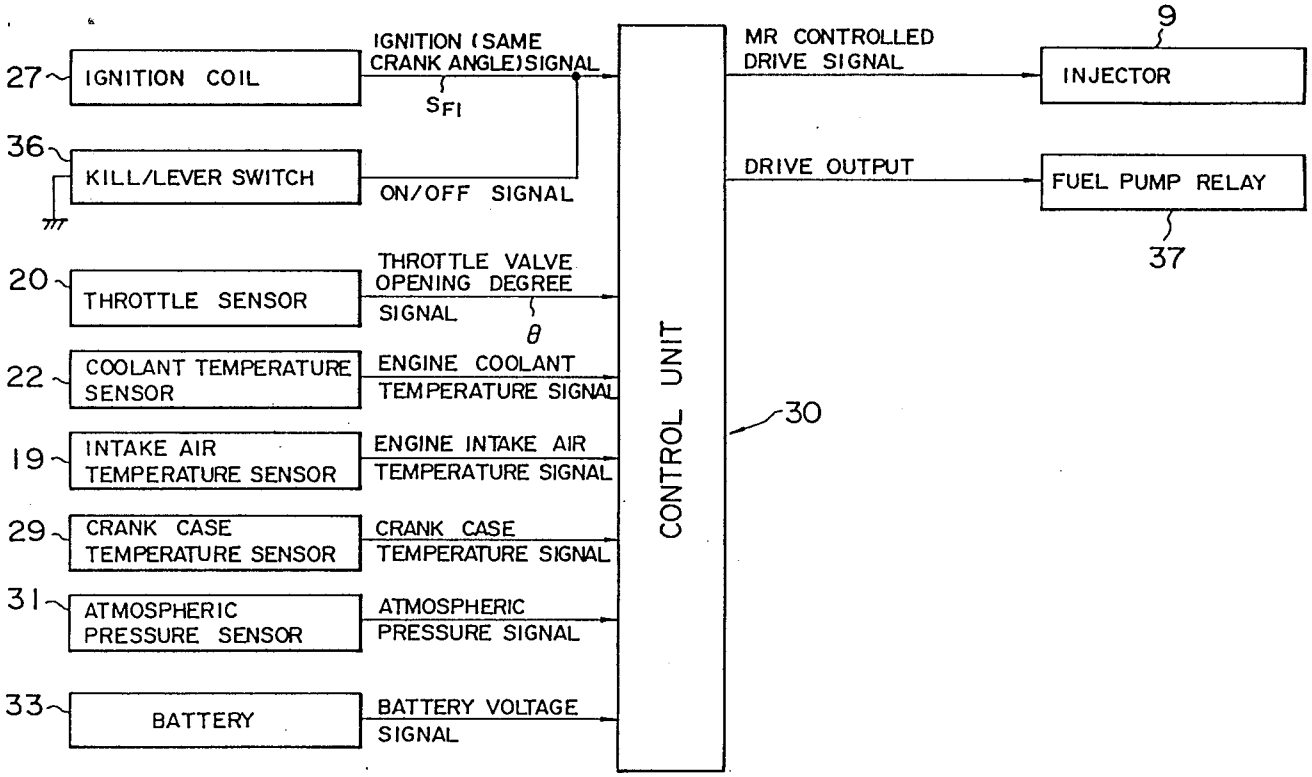
FIG. 3 is a block diagram showing the connection state of a series of inputs and controlled objects to the engine control unit.

The interconnection of the above-described constitutional elements relative to the control unit 30 is shown in FIGS. 2 and 3. FIG. 2 illustrates a series of detection signal inputs 30B to the unit 30, commands to the injector 9, and a schematic circuit arrangement of other elements. FIG. 3 is a block diagram showing the interconnection cf the control unit 30 to respective constitutional elements. Similar or identical constitutional elements to those shown in FIG. 1 are represented by using identical reference numerals in FIGS. 2 and 3, and description thereof is omitted to avoid duplication. In this embodiment, two injectors 9 and two dropping resistors 38 are provided for the first cylinder (No.1) and second cylinder (No.2), respectively, to simplify the explanation.

The operation of the whole control system for the two-cycle engine constructed as above will be described briefly.

Upon turning on the ignition switch 34, a voltage is applied from the battery 33 to the exciting coil unit 32b of the relay 32 so that the switch unit 32a is turned on and the control unit 30 is activated. The control unit 30 sends control signals to the injector 9 and fuel pump 16 in accordance with the signals output from various sensors and switches and supplied to the input side of the control unit 30. A fixed ignition signal is picked up from the primary winding of the ignition coil 27 of the CDI magneto unit 23, to thereby calculate an engine speed $S_E$. The KILL switch 35 and lever switch 36 are kept open in an ordinary state. The switch 35 is manually closed by an operator, and the switch 36 is automatically closed when icing occurs. When one of the switches 35 and 36 is closed, the primary winding of the coil 27 is grounded so that the engine is stopped. When the ignition switch 34 is turned off after the engine stop, the exciter coil 32b of the relay 32 is grounded via one of the switches 35 and 36 so that power to the unit 30 is disconnected.

Figure 4:
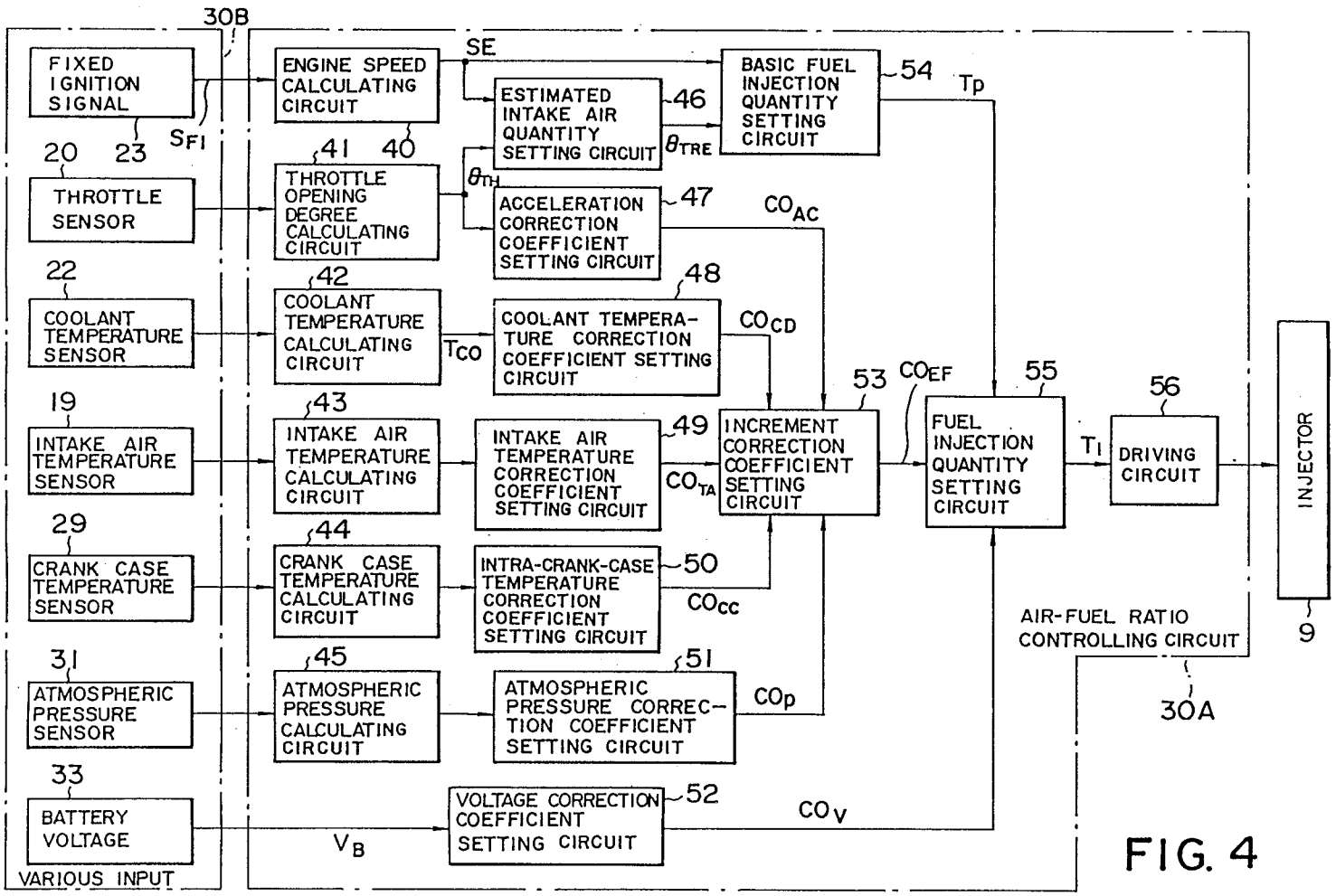
FIG. 4 is a block diagram showing the function and structure of the embodiment of the air-fuel ratio control system of the present invention.

Next, the function and structure of an air-fuel ratio controlling circuit 30A provided within the control unit 30 will be described with reference to FIG. 4.

The controlling circuit 30A include: calculating circuits 40 to 45 for calculating various control quantities in accordance with a series of inputs from various sensors and the like; correction coefficient setting circuits 46 to 53 for setting various correction quantities in accordance with the values calculated by the calculating circuits 40 to 45; a setting circuit 54 for setting a basic fuel injection quantity in accordance with the engine speed and the intake air quantity; a setting circuit 55 for setting an actual fuel injection quantity in accordance with the basic fuel injection quantity and various increment correction coefficient set by the setting circuits 46 to 53; and a driving circuit 56 for driving the injector 9 in accordance with a value set by the fuel injection quantity setting circuit 55.

Specifically, the calculating circuits 40 to 45 of the circuit 30A include: an engine speed calculating circuit 40 for calculating the engine speed $S_E$ per unit time in dependency on the fixed ignition signal $S_{FI}$ from the CDI magneto unit 23; a throttle opening degree calculating circuit 41 for calculating a throttle opening degree $\theta_{TH}$ in accordance with the output from the throttle sensor 20; a coolant temperature calculating circuit 42 for calculating a coolant temperature $T_{CO}$ in accordance with a value detected by the coolant sensor 22; an intake air temperature calculating circuit 43 for calculating an intake air temperature $T_A$ in accordance with a value detected by the intake air temperature sensor 19; a crank case temperature calculating circuit 44 for calculating a crank case temperature $T_{CC}$ in accordance with a value detected by the crank case temperature sensor 29; and an atmospheric pressure calculating circuit 45 for calculating an atmospheric pressure $P_O$ in accordance with a value detected by the atmospheric pressure sensor 31.

In accordance with various values calculated by the calculating circuits 40 to 45, various coefficients are set by the next stage various setting circuits 46 to 52. Specifically, estimated intake air quantity setting circuit 46 sets an estimated intake air quantity $Q_{PRE}$ in accordance with the engine speed $S_E$ and throttle opening degree $\theta_{TH}$ by using the following function:

$$Q_{PRE}=f(S_E, \theta_{TH}) \quad (1)$$

The estimated intake air quantity $Q_{PRE}$ may be obtained by searching in a memory map wherein the estimated intake air quantity is stored with respect to the engine speed $S_E$ and throttle opening degree $\theta_{TH}$ as parameters.

Acceleration correction coefficient setting circuit 47 set an acceleration correction coefficient $CO_{AC}$ in accordance with the read throttle opening degree $\theta_{TH}$.

Coolant temperature correction coefficient setting circuit 48 set a coolant temperature correction coefficient $CO_{CO}$ in accordance with the coolant temperature $T_{CO}$. The coolant temperature correction coefficient $CO_{CO}$ is set in accordance with the coolant temperature $T_{CO}$ which represents the condition of the engine such as in the knocking occurrence range during a large load operation, which requires to cool the fuel, over heating range, warm air running range or the like, respectively.

An intake air temperature correction coefficient setting circuit 49 sets an intake air temperature correction coefficient $CO_{CO}$ in accordance with the intake air temperature $T_A$ relative to the air density. Namely, at the setting circuit 49, the change of the intake air temperature $T_A$ is detected to thereby correct the basic fuel injection quantity in accordance with the air density.

An intra-crank-case intake air temperature correction coefficient setting circuit 50 detects a temperature change of the intake air supplied to the crank chamber 2a in accordance with the intra-crank-case temperature $T_{CC}$, and set an intra-crank-case intake air temperature correction coefficient $CO_{CO}$. More in particular, in the two-cycle engine, since the intake air is temporarily introduced into the crank chamber 2a serving also as the pressure chamber, the air density changes with the internal temperature (warm or cool) of the crank case 2. This air density change greatly influences the scavenging efficiency (almost the same as charging efficiency) and air-fuel ratio. In view of this, the basic fuel injection quantity is corrected on the basis of the air density change depending to the intra-crank-case intake air temperature.

An atmospheric pressure correction coefficient setting circuit 51 sets an atmospheric pressure correction coefficient $CO_P$ in accordance with the atmospheric pressure $P_O$. This correction is carried out by reading the atmospheric pressure so as to deal with an atmospheric pressure change in an environment where the engine is located such as a high land, or with four seasons.

A voltage correction coefficient setting circuit 52 sets a voltage correction coefficient $CO_V$ representative of an invalid injection time of the injector 9, in accordance with the output voltage $V_B$ of the battery 3.

The acceleration correction coefficient $CO_{AC}$, coolant temperature correction coefficient $CO_{CO}$, intake air temperature correction coefficient $CO_{TA}$, intra-crank-case intake air temperature correction coefficient $CO_{CO}$ and atmospheric pressure correction coefficient $CO_P$ are temporarily supplied to an increment correction coefficient setting circuit 53. The setting circuit 53 sets an increment correction coefficient COEF for increasing the fuel injection quantity, by using the following equation:

$$COEF=CO_{CO}+CO_{AC}+CO_{TA}+CO_{CC}+CO_P \quad (2)$$

and supply the increment correction coefficient COEF to the fuel injection quantity setting circuit 55.

The basic fuel injection quantity setting circuit 54 sets the basic fuel injection quantity $T_P$ in accordance with the engine speed $S_E$ supplied from the engine speed calculating circuit 40 and the estimated intake air quantity $Q_{PRE}$ supplied from the estimated intake air quantity setting circuit 46. The basic fuel injection quantity $T_P$ is obtained as a fuel injection time in this embodiment, by the following equation:

$$T_P=k\times Q_{PRE}/(A/F) \quad (3)$$

where k is a constant and A/F is an air-fuel ratio.

The fuel injection quantity $T_I$ by the following equation:

$$T_I=T_P\times COEF+CO_V \quad (4)$$

in accordance with the basic fuel injection quantity $T_P$, increment correction coefficient COEF and voltage correction coefficient $CO_V$ respectively supplied from the setting circuits 52 to 54.

The driving circuit 56 supplied with the fuel injection quantity $T_I$ outputs as a drive command a fuel injection pulse corresponding to the fuel injection quantity $T_I$ to the injector 9 at the predetermined timing.

The control of the fuel pump 16 by the control unit 30 is conducted, for example, in such a manner that after a predetermined time (e.g., 5 seconds) from the turning-on of a starter switch (not shown), when the fixed ignition signal $S_{FI}$ from the ignition coil 27 of the CDI magneto unit 23 is inputted, the coil unit 37a of the relay 37 is exerted and the switch unit 37b is turned on to thereby activate the fuel pump 16. In the description of the above embodiment, the setting circuit 46 sets the estimated intake air quantity $Q_{PRE}$ by using the function (1) in dependency on the engine speed $S_E$ and throttle opening degree $\theta_{TH}$. The present invention is not limited thereto, but the basic fuel injection quantity $T_P$ may be obtained, as described previously, by searching the memory map with respect to both parameters.

Furthermore, instead of calculating by using the equation (1) and (2), other equations may be used as well.

Still furthermore, the basic fuel injection quantity $T_P$ may undergo an air-fuel ratio feedback control in accordance with an oxygen concentration of the fuel gas measured with an oxygen sensor ($O_2$ sensor).

As described in detail above, the air-fuel ratio control system for the two-cycle engine of the present invention comprises the increment correction coefficient circuit for setting an increment correction coefficient of a crank case serving also as a pressure chamber, the basic fuel injection quantity setting circuit for setting a basic fuel injection quantity by using as parameters the engine speed and throttle opening degree, and fuel injection quantity setting circuit for setting a fuel injection quantity by correcting the basic fuel injection quantity in accordance with the increment correction coefficient. It is therefore possible to properly correct and set the fuel injection quantity by using a correction coefficient term corresponding to the actual engine temperature condition. As a result, the control performance of an air-fuel ratio can be improved considerably, and the engine output and fuel consumption can be improved. There are provided further advantageous effects that exhaust air emission can be improved.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. An air-fuel ratio control system for a two-cycle engine having a cylinder, a crank case serving also as a pressure chamber to supply the intake air to the cylinder, a fuel injection unit including an injector and injection pump, engine speed detection means for detecting an engine speed, and throttle opening degree detection means for detecting opening degree of a throttle valve, said air fuel ratio control system comprising:

crank case temperature detection means for detecting the temperature of said crank case;

first setting means for setting an increment correction coefficient for increasing a fuel injection quantity, in dependency on the temperature of said crank case detected by said crank case temperature detection means;

second setting means for setting a basic fuel injection quantity in response to said engine speed and said throttle opening degree respectively detected by said engine speed detection means and said throttle opening degree detection means; and third setting means for setting a fuel injection quantity by correcting said basic fuel injection quantity set by said second setting means in accordance with said increment correction coefficient set by said first setting means.

2. The air-fuel ratio control system as set forth in claim 1; wherein said first setting means receive an acceleration correction coefficient set in dependency on the throttle opening degree, coolant temperature correction coefficient set in dependency on the coolant temperature, intake air temperature correction coefficient set in dependency on the intake air temperature, and atmospheric pressure correction coefficient set in dependency on an atmospheric pressure and set increment correction coefficient, and said increment correction coefficient is supplied to said third setting means.

3. The air-fuel ratio control system as set forth in claim 1, comprising:

estimated intake air quantity setting means for setting an estimated intake air quantity in dependency on said engine speed and the throttle opening degree; and said second setting means set said basic fuel injection quantity in dependency on the engine speed and the estimated intake air quantity.

4. The air-fuel ratio control system as set forth in claim 3; wherein said estimated intake air quantity is obtained by searching a map within a storage means of a control unit in dependency on said engine speed and said throttle opening degree.

5. The air-fuel ratio control system as set forth in claim 1; wherein said crank case temperature detecting means detects the temperature within said crank case.

6. The air-fuel ratio control system as set forth in claim 1; wherein said crank case temperature detecting means detect the wall temperature of said crank case.

* * * * *